US010711426B2

(12) United States Patent
Everett

(10) Patent No.: US 10,711,426 B2
(45) Date of Patent: Jul. 14, 2020

(54) BLOWER CONTROL SYSTEM

(71) Applicant: BTECH, Inc, Rockaway, NJ (US)

(72) Inventor: David Allen Everett, Hawthorne, NJ (US)

(73) Assignee: BTECH Inc., Rockaway, NJ (US)

( * ) Notice: Subject to any disclaimer, the term of this patent is extended or adjusted under 35 U.S.C. 154(b) by 230 days.

(21) Appl. No.: 15/862,763

(22) Filed: Jan. 5, 2018

(65) Prior Publication Data

US 2018/0127945 A1 May 10, 2018

Related U.S. Application Data

(62) Division of application No. 14/630,803, filed on Feb. 25, 2015, now Pat. No. 9,863,116.

(60) Provisional application No. 61/944,089, filed on Feb. 25, 2014.

(51) Int. Cl.
*E02D 31/00* (2006.01)
*F24F 11/00* (2018.01)

(52) U.S. Cl.
CPC ..... *E02D 31/008* (2013.01); *F24F 11/0001* (2013.01)

(58) Field of Classification Search
CPC ..... E02D 31/008; F24F 11/0001
USPC ..... 454/340, 909
See application file for complete search history.

(56) References Cited

U.S. PATENT DOCUMENTS 4,843,786 A 7/1989 Walkinshaw et al.
4,938,124 A 7/1990 Garza
5,101,712 A 4/1992 Dean, Jr.
5,131,887 A 7/1992 Traudt
6,848,623 B2 2/2005 Weimer et al.
2004/0188532 A1 9/2004 Weimer et al.
2011/0195652 A1* 8/2011 Smith ..... H05K 7/20836 454/184
2012/0328378 A1 12/2012 Hatton et al.
(Continued)

FOREIGN PATENT DOCUMENTS

EP 1653008 A1 5/2006
KR 20130020101 A 2/2013

OTHER PUBLICATIONS

Larsen & Toubro Limited, Application Note Fan/Blower/Pump with PID Control, Dec. 13, 2013.
(Continued)

*Primary Examiner* — Edelmira Bosques
*Assistant Examiner* — Dana K Tighe
(74) *Attorney, Agent, or Firm* — Mark Nowotarski

(57) ABSTRACT

A controller for controlling a system for mitigating the flow of vapors from contaminated soil into a building controls a blower pulling an exhaust from underneath the sub slab of the building and blowing the vapors away from the building. The blower is controlled by pressure sensors that measure the pressure drop across the sub slab. The sensors are monitored by the controller to make sure they all have a minimum pressure drop. If any of the sensors have an inadequate pressure drop, the blower speed is increased a small amount by the controller. If all of the sensors have adequate pressure drop, then the blower speed is decreased by a small amount. The controller then rechecks the pressure drops on a periodic basis and makes appropriate blower speed adjustments after each measurement.

17 Claims, 5 Drawing Sheets

(56) References Cited

U.S. PATENT DOCUMENTS

2014/0252099 A1 9/2014 Hatton et al.

OTHER PUBLICATIONS

William Brodhead and Thomas E. Hatton, High Vacuum, High Airflow Blower Testing and Design for Soil Vapor Intrusion Mitigation in Commercial Budilings, Sep. 2010.
EPA Engineering Issue: Indoor Air Vapor Intrusion Mitigation Approaches pp. 1-26, Jan. 10, 2014.
EPA Engineering Issue: Indoor Air Vapor Intrusion Mitigation Approaches pp. 27-49, Jan. 10, 2014.
Thomas E. Hatton and Michael D. Salcone, Applying Dynamic Controls™ to Vapor Intrusion Mitigation Systems to Manage Pressure Differentials, Effluent Concentrations and Energy Conservation, Jan. 10, 2014.
Thomas E. Hatton, 2010 International Radon Symposium, Columbus, OH; Designing Efficient Sub Slab Venting and Vapor Barrier Systems for Schools and Large Buildings, Oct. 2010.
Thomas E. Hatton, Evaluating Large Buildings and Assessing the Feasibility of Applying Active Soil Depressurization as a Remedial Solution for Vapor Intrusion; Jan. 2009.
Indoor Air Technologies, Inc,About IAT, http://www.indoorair.ca/iat/index.php, Dec. 13, 2013.
MACTEC, Letter dated Mar., 31, 2008 to Mr. Joseph T. Martella re: Active Soil Depressurization System Design, Jan. 10, 2014.
Radonaway, Installation & Operating Instructions P/N. IN015 Rev E, Mar. 26, 2014.
Wikipedia, PID Controller, Dec. 17, 2013.
U.S. Appl. No. 61/825,792 Hatton and Salcone filed May 21, 2013, Vapor Mitigation System, Vapor Mitigation Controller and Methods of Controlling, Monitoring and Mitigating Vapors.
English translation of Foreign Reference KR 20130020101 A.
Search and Opinion for PCT/US2015/017413 from Korean Patent Office dated Jun. 3, 2015.

* cited by examiner

BLOWER CONTROL SYSTEM

FIELD OF INVENTION

The inventions described herein are generally in the field of building ventilation.

BACKGROUND

Many buildings are located on contaminated ground. The contamination may be a toxic volatile substance, such as a volatile organic compound (VOC), or a radioactive gas, such as radon. These toxic volatile substances must be kept out of a building to maintain the health of the people within the building. One way to reduce the incursion of toxic vapors is to reduce the pressure in the ground below the building so that air within the building flows down into the ground. Thus vapors in the ground cannot flow into the building. Many buildings have a concrete slab or other relatively impermeable layer as their lower boundary with the ground. This relatively impermeable layer is called a "sub slab". The pressure below the sub slab can be reduced by using an exhaust blower. The blower sucks air from underneath the sub slab and exhausts it away from the building. Blowers require power. There is need, therefore, for a blower control system that minimizes power without allowing ground vapors into a building.

SUMMARY OF THE INVENTION

The summary of the invention is provided as a guide to understanding the invention. It does not necessarily describe the most generic embodiment of the invention. As used herein, the term "about" or its equivalents means plus or minus 10% of a given value unless specifically indicated otherwise.

FIG. 1 illustrates an exemplary Blower Control System. A building 100 rests on or below ground level 110. A source 112 of toxic or otherwise undesirable vapors 114 is below the building. The building comprises an outer shell 102 (e.g. walls and roof) and a sub slab 104. An exhaust blower 142 is connected to a point 146 below the sub slab by a duct 144 (also termed a "riser"). The duct has an inlet at point 146. Air from below the sub slab is pulled into the duct and exhausted outside and away from the building 148. This reduces the pressure below the sub slab causing air to flow from the building down into the ground. This keeps toxic fumes from entering the building. The blower may be connected to additional ducts (not shown) that exhaust from additional points below the sub slab. The reduced pressure below the sub slab causes air 132, 134, 136 at various points within the building to flow through openings in said sub slab. Air may also flow through the surface of the ground outside of the building 138 to the exhaust. Any fumes 114 emitted by the contamination are swept up in said air and exhausted.

The air that flows out of the building through the sub slab must be replaced by outside air that flows into the building. Outside air 150 may be introduced through the building's heating ventilating and air conditioning system (HVAC) 152. It may also enter the building through fixed openings 154, such as cracks, or intermittent openings 156, such as doors or windows.

The pressure drop across the sub slab will vary in an uncertain way due to a number of factors. The pressure drop is computed by measuring the pressure below the sub slab at different points 122, 124, 126, relative to a reference pressure 121 above the sub slab. The pressure drop 124 near the exhaust point 146 may be higher than the pressure drop 122 far from the exhaust point. If there are submerged obstructions 116, then the pressure drop 126 in some areas near the exhaust point may be lower than other areas 124 equally near the exhaust point. It is advisable, therefore, to monitor the pressure drop across the sub slab at multiple points.

The pressure drop at various points across the sub slab can vary over time due to a variety of factors acting on a broad range of time scales. As used herein, "time scale" refers to how long a given quantity takes to make a significant change (e.g. more than 10%). If a window 156 is opened, for example, then the reference pressure 121 may increase and the pressure drop across the sub slab will correspondingly increase on a time scale of a few seconds. Thus the exhaust blower 142 would have to be adjusted on a time scale of a few seconds so that the pressure drop across the sub slab remains within its desired range. Weather factors, such as the sun 162 warming up the building during the day, and wind 164 changing the flows through the building openings 154, can cause changes in pressure drop across the sub slab on a time scale of hours. The system controlling the exhaust blower, therefore, must also respond on a time scale of hours. Finally, long term factors, such as seasonal climate changes and changes in soil moisture which affect gas permeability below the sub slab means that the system controlling the exhaust blower must respond on time scales ranging from days to months and even years.

A controller 120 can monitor all of the pressure points below the sub slab and control 128 the exhaust blower 142 so that adequate pressure drop is maintained for all of the points. A minimum pressure drop across each monitored point in the sub slab may be selected. 0.01 inches of water column (inches WC) is a suitable minimum pressure drop. This is termed the "desired value". The system checks the pressure drops at least once during a control period, such as once every 5 seconds. If any of the pressure points are less than the desired value, then the blower can be increased. If all of the pressure points are above the desired value, then the blower can be decreased. It has been surprisingly discovered that this control mechanism allows the exhaust blower to respond to pressure drop changes ranging in time scale from less than minutes to more than months. The system is further improved if the magnitude of the fractional blower change at each control period is proportional to the magnitude of the fractional deviation of a measured pressure drop from the desired pressure drop.

The system can alternatively measure other indications of adequate flow from the building through the sub slab. These alternative measures include contaminant level in the air in the building, flow rate through the riser 144, or pressure in the riser.

DETAILED DESCRIPTION

The detailed description is exemplary and not limiting. Any features described herein may be combined with any other features to provide at least the benefits described herein.

Figure 1:
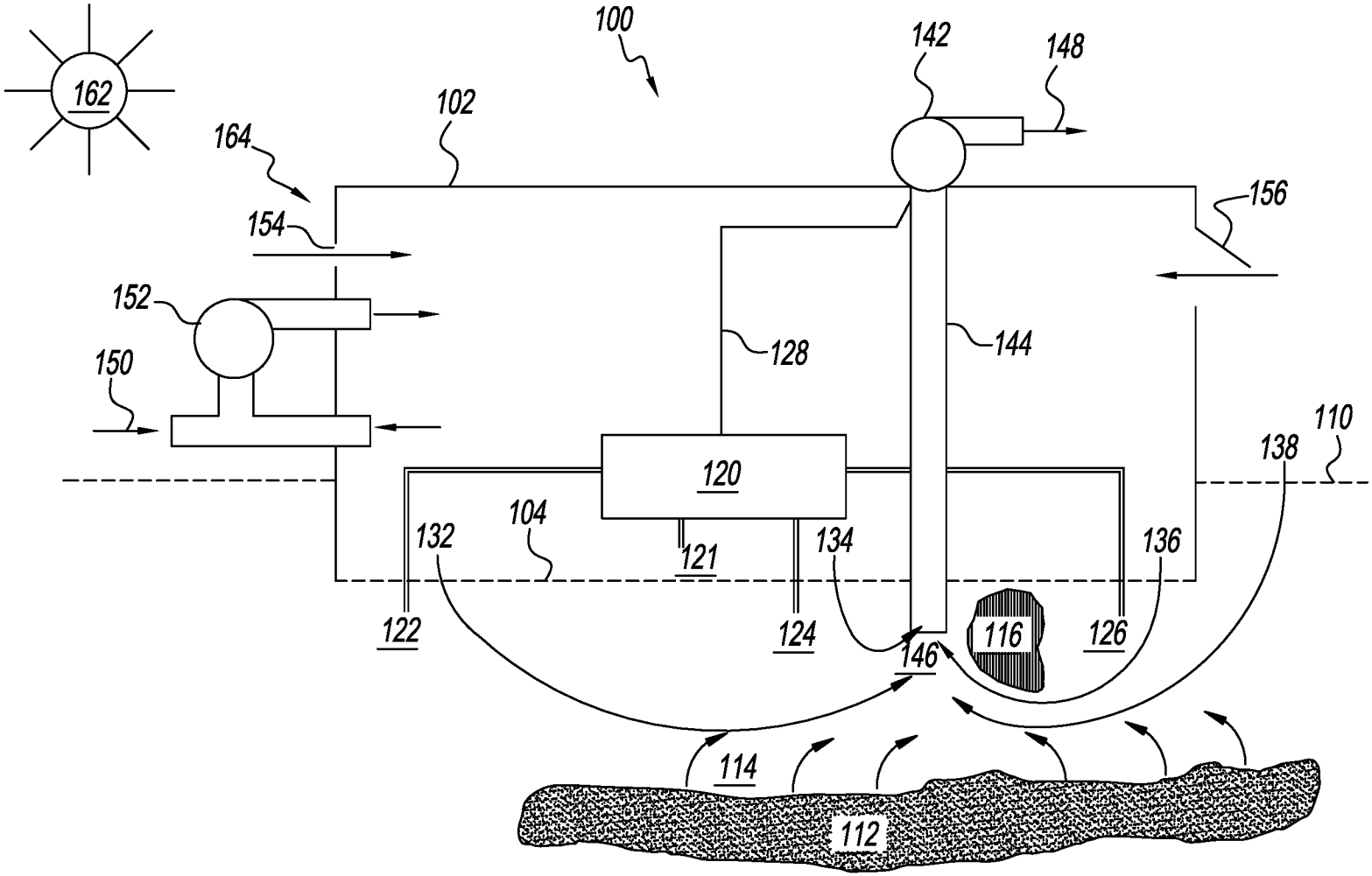
FIG. 1 is an illustration of an exemplary blower control system.
Figure 2:
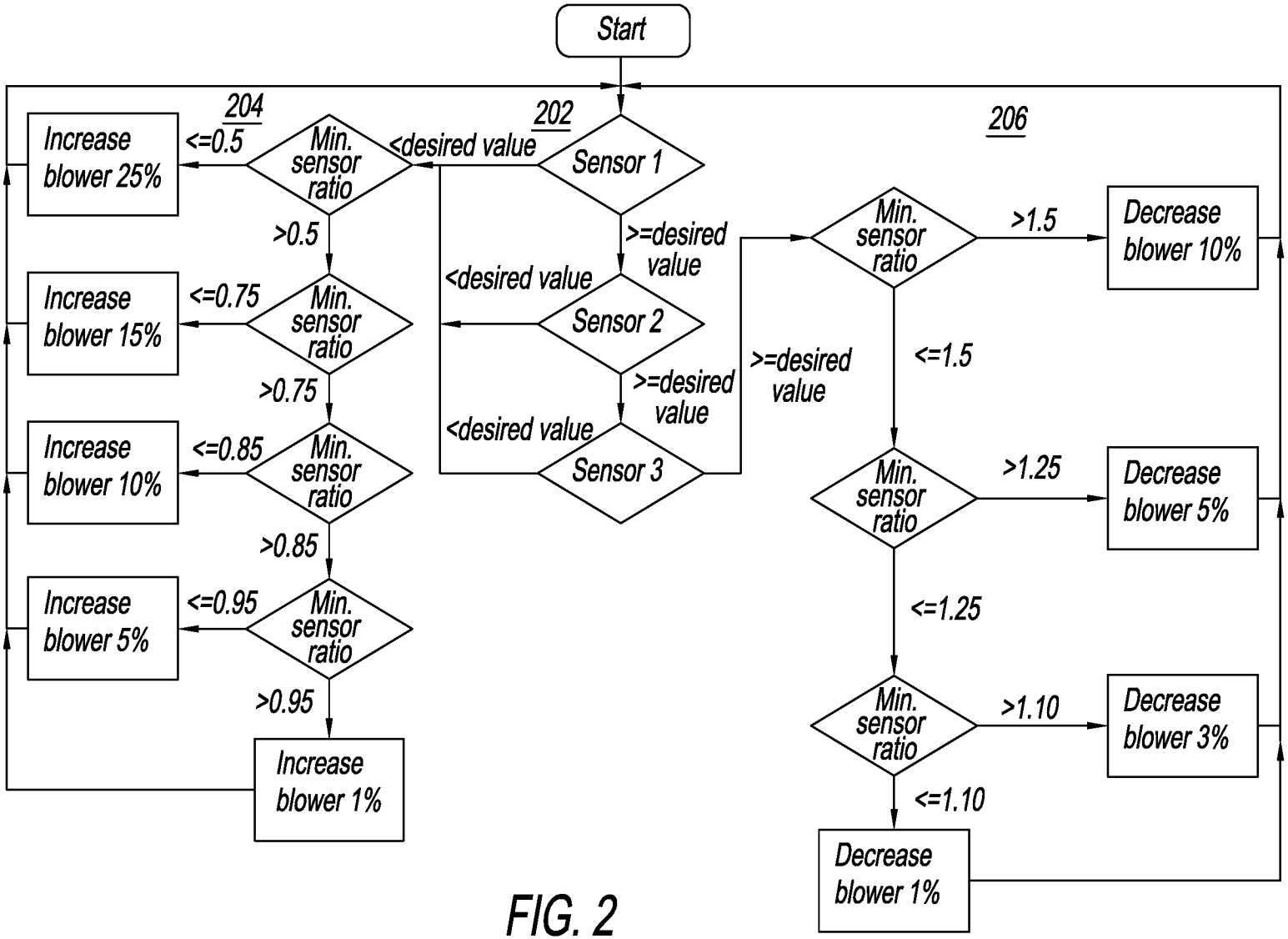
FIG. 2 is a flow chart of a suitable algorithm for controlling an exhaust blower.

FIG. 2 is a flow chart of an exemplary control algorithm for a sub slab exhaust blower. A control period is first selected. Suitable control periods are in the range of once per second to once per 5 seconds. Longer or shorter control periods can be selected depending upon the response times needed. A suitable minimum control period is 10% of the time it takes the pressure in a building to respond to a sudden change in building configuration, such as a window opening or closing.

At the beginning of each control period 202, the system checks the pressure drop at each sensor (Sensor #1, Sensor #2, Sensor #3). Any number of sensors may be provided. The ratio of sensor value to desired value is calculated for each sensor. Each sensor may have its own desired value or the same desired value may be used for multiple sensors. If the minimum sensor ratio is less than 1 (i.e. not enough pressure drop at the sensor location), then the control system increases the blower speed 204. If the minimum sensor ratio is greater than or equal to 0.5, for example, then the blower speed is increased by 25%. If the minimum sensor ratio is in the range of 0.75 to 0.5, then the blower speed is increased 15%. Reducing the fractional change in blower speed with increasing minimum sensor ratios is termed "progressive control". In this example, the minimum increase in blower speed is 1% if the minimum sensor ratio is in the range of 0.95 to 1.0. The minimum increase in blower speed may be set to zero. This would correspond to there being a "dead band" where no change would be made to blower speed if the minimum sensor ratio was below a minimum value.

If all of the sensors are at or above their desired values, the system then checks to see how much the blower power should be decreased 206. If the minimum sensor ratio, for example, is greater than 1.5, then the blower speed is decreased by 10%. If the minimum sensor ratio is in the range of 1.25 to 1.5, then the blower speed is decreased by 5%. The minimum decrease in blower speed for any given control period is a decrease of 1% when the minimum sensor ratio is in the range of 1.0 to 1.1.

After the adjustment to blower speed is made, the system repeats the process at the next control period.

An advantage of progressive control is that the same system can accommodate changes in pressure drop on widely varying time scales. If there is sudden change in pressure drop during a control period, such as a large door to the building opening or closing, the system will take large actions to correct for it and hence respond quickly. On the other hand, if small changes happened over the course of a large number of control periods, such as a change of seasons, then the system will constantly make small adjustments to respond over the corresponding time scale.

The relationship between fractional change in blower power or speed and minimum sensor ratio may be linear. It may also be non-linear. Any number of different control levels may be provided including continuous analog control. A very simple embodiment is that the system increases the blower speed by a "fractional increase amount" if the minimum sensor ratio is less than 1 or decreases the blower by a "fractional decrease amount" if the minimum sensor ratio is more than 1. This is termed "bimodal control".

Other factors may be monitored by one or more sensors in addition to, or instead of, pressure drop sensors across the sub slab. The air above the sub slab, for example, could be monitored for the contaminant that is in the ground below. Thus the system could increase the blower if contaminant is sensed within the building even if all of the pressure sensors indicate that there is adequate pressure drop across the slab at each monitored point. If a sensor measures a quantity that is inversely related to the flow of air through the sub slab, then the sensor ratio is computed by dividing the desired value by the measured value. If a desired contaminant level, for example is 100 ppm and a measured contaminant level in the building is 200 ppm then more exhaust flow is needed through the sub slab. The sensor ratio, therefore, is computed to be 100/200 or 0.5.

The values for each blower increase or decrease and the length of the control periods can be selected to match the response times of the building and exhaust system to different changes. If a system overshoots its desired values, for example, the fractional increases or decreases in blower control can be reduced in magnitude or the cycle times can be increased.

EXAMPLE 1

A laboratory system was set up to simulate a building control system. A blower was attached to a duct that pulled air through a bed of gravel. The pressure in the gravel was monitored relative to the pressure above the gravel. This simulated a sub slab pressure drop. The system was set up with a bimodal control and a one-second cycle period. The results are shown in FIG. 3.

Figure 3:
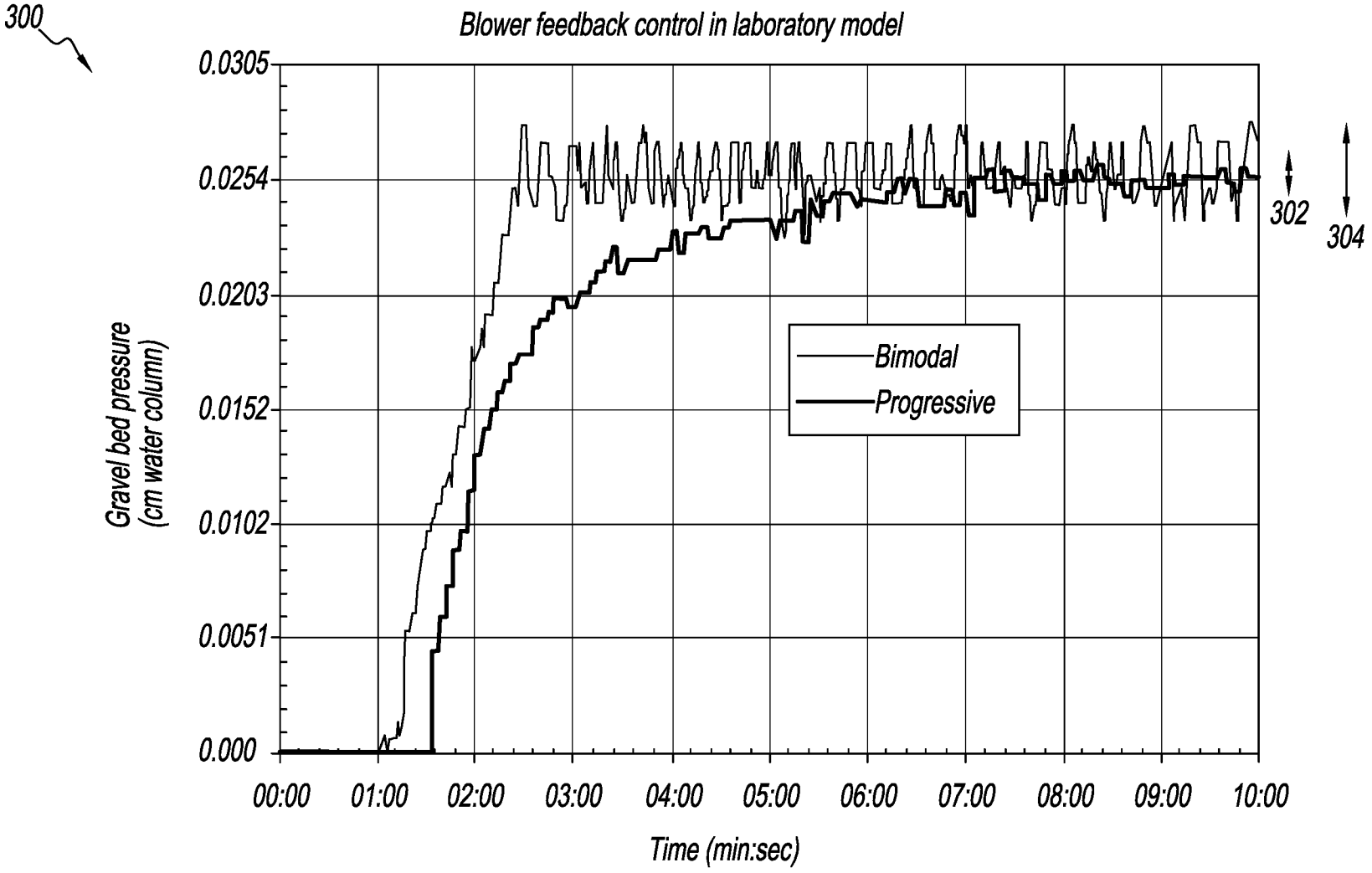
FIG. 3 is a graph comparing a bimodal control algorithm with a progressive algorithm.

FIG. 3 shows a graph 300 of the pressure above the gravel bed versus time. The units of pressure are inch WC. The units of time are min:sec. At time=0:00, the system was turned on. The desired value for the pressure sensor was 0.01 inch WC. For the bimodal control run, the measured pressure drop increased until the desired value was reached. The pressure, however, showed significant oscillations 304 about its set point. The oscillations could be reduced either by increasing the cycle time or decreasing the adjustment to the blower speed at each cycle. The system, however, would then respond slower to a sudden change in pressure drop.

The experiment was repeated with a progressive control system and a cycle period of 5 seconds. This data is also plotted in FIG. 3. The fractional change in blower speed was proportional to the ratio of measured pressure to desired pressure. The pressure rose at about the same rate as the bimodal system and approached its set point asymptotically. The variations about the desired value 302, however, were much smaller than the bimodal system.

EXAMPLE 2

A progressive control system was set up on a sub slab exhaust system for a large industrial building. Sub slab pressure was monitored at multiple locations. The fractional change in blower speed was proportional to the minimum pressure drop ratio for the sensor locations. The blower speed was tracked over several days. The results are shown in FIG. 4.

Figure 4:
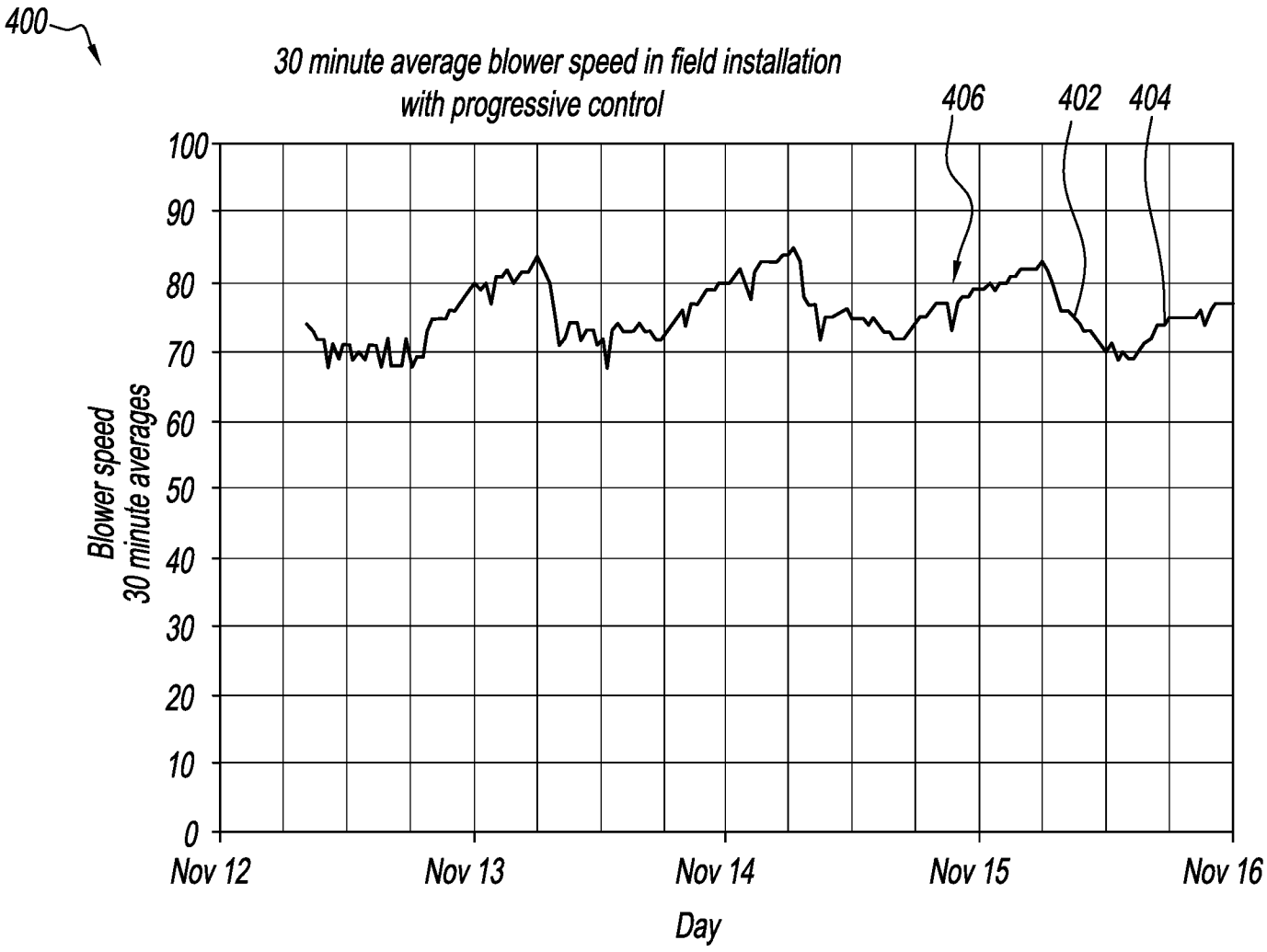
FIG. 4 is a graph of 30 minute averages of blower speed for a field installation of a blower control system.

FIG. 4 shows a graph 400 of blower speed versus time. Blower speed is an indicator of blower power. Each point is a 30 minute average. Blower speed is shown on a relative scale with 100 corresponding to full power. Blower speed decreased during the day 402 and increased during the night 404. This may be due to warming and cooling of the building. Blower speed would also adjust to sudden changes 406. These may be due to door openings and closings.

During these changes, the sub slab pressure drops always stayed within acceptable limits. The control system was also equipped with internet communications so its performance could be monitored remotely and reports could be prepared to show compliance with environmental regulations.

EXAMPLE 3

The same system as Example 2 was tracked over several months. The results are shown in FIG. 5.

Figure 5:
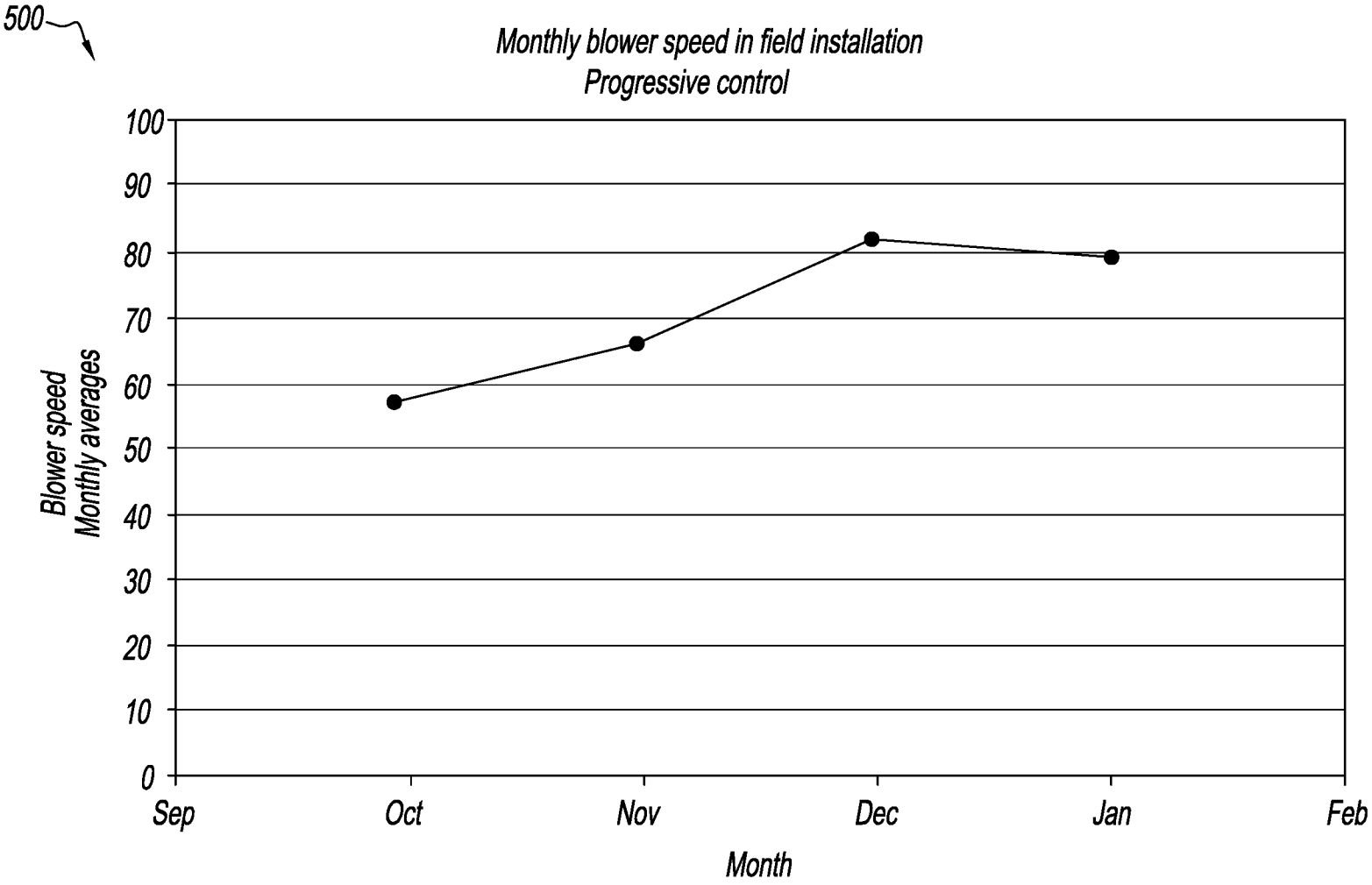
FIG. 5 is a graph of monthly averages of blower speed for the field installation of FIG. 4.

FIG. 5 shows a graph 500 of blower speed versus time. Each point is a one month average. Blower speed is shown on a relative scale. 100 corresponds to full power. Average monthly blower speed increased from October to January in response to overall weather changes. Thus power use was optimized on a seasonal basis.

Computer Control

The control systems described herein may be implemented on a programmable device, such as a programmable controller or digital computer. The programmable device may comprise a microprocessor, an input device for receiving signals from sensor, an output device for controlling a blower and a permanent memory. The permanent memory may comprise instructions that will cause the microprocessor to execute the steps of the processes described herein.

Analog Control

The control systems described herein may be implemented on electrical analog controllers where the voltage/current characteristics of the control circuit (e.g. operational amplifies) are designed to provide the appropriate control feedback.

Pneumatic Control

The control systems described herein may be implemented on a pneumatic control system where the pressure flow characteristics of the pneumatic elements (e.g. pressure regulators) are designed to provide the appropriate control feedback.

We claim:

1. A controller for a sub slab exhaust system, said controller comprising an input device adapted to receive one or more input signals from one or more pressure sensors each adapted to measure a pressure drop at a location below a sub slab of a first building relative to a pressure above said sub slab; an output device adapted to produce an output signal to control a speed of a blower adapted to exhaust air below said sub slab; a microprocessor programmed to perform calculations based on said one or more input signals to control said output signal; and a permanent memory comprising computer readable instructions to cause said microprocessor to carry out at least the steps of:

i) at the beginning of a first control cycle period, measure said one or more pressure drops indicated by said one or more input signals from said one or more pressure sensors;

ii) determine the ratio of each of said measured pressure drops to a desired pressure drops for each of said pressure sensors;

iii) determine the minimum of said pressure drop ratios and either:

1) output by said output device, an output signal adapted to increase said blower speed by a first fractional increase if said minimum of said pressure drop ratios is between a first amount and 1 wherein said first amount is less than 1;

2) output by said output device, an output signal adapted to increase said blower speed by a second fractional increase if said minimum of said pressure drop ratios is less than said first amount; or 3) output by said output device, an output signal adapted to decrease said blower speed by a first fractional decrease if said minimum of said pressure drop ratios is greater than or equal to 1; and iv) execute steps i), ii) and iii) at the beginning of a second control cycle period.

2. The controller of claim 1 wherein said first fractional increase is about 1% and said first control cycle period is about 1 second.

3. The controller of claim 1 wherein each of said desired pressure drops for each of said pressure sensors is 0.01 inch WC or greater.

4. The controller of claim 1 wherein said second fractional increase is about 5% and said first amount is about 0.95.

5. The controller of claim 1 wherein said first fractional increase is zero and said second fractional increase is greater than zero.

6. The controller of claim 1 wherein said steps comprise:

a) output by said output device, an output signal adapted to increase said blower speed by a third fractional increase if said minimum of said pressure drop ratios is less than a second amount wherein said second amount is less than said first amount.

7. The controller of claim 6 wherein said third fractional increase is about 10% and said second amount is about 0.85.

8. The controller of claim 1 wherein said first fractional increase is more than said first fractional decrease.

9. The controller of claim 1 which further comprises an internet communication system for receiving remote instructions to control said microprocessor and transmitting compliance data from said microprocessor.

10. The controller of claim 1 wherein said input device is adapted to receive said input signals from three or more pressure sensors.

11. The controller of claim 1 wherein said first control cycle period is less than about 10% of the time it takes the pressure in said first building to respond to a sudden change in building configuration.

12. The controller of claim 11 wherein said sudden change in building configuration is an exterior door opening.

13. A controller for a sub slab exhaust system, said controller comprising an input device adapted to receive one or more input signals from one or more sensors measuring one or more indications of adequate air flow from a first building out through a sub slab of said first building; an output device adapted to produce an output signal to control a speed of a blower adapted to exhaust air from below a sub slab of a first building; a microprocessor for performing calculations based on said one or more input signals to control said output signal; and a permanent memory comprising instructions to cause said microprocessor to carry out at least the steps of:

i) at the beginning of a first control cycle period, measure said one or more indications of adequate air flow according to said one or more input signals from said one or more sensors;

ii) determine the ratio each of said measured indications to a desired indication for each of said sensors;

iii) determine the minimum of said measured ratios and either:

1) output by said output device, an output signal adapted to increase said blower speed by a first fractional increase if said minimum of said measured ratios is between a first amount and 1 wherein said first amount is less than 1;

2) output by said output device, an output signal adapted to increase said blower speed by a second fractional increase if said minimum of said measured ratios is less than said first amount; or 3) output by said output device, an output signal adapted to decrease said blower speed by a first fractional decrease if said minimum of said measured ratios is greater than or equal to 1; and iv) execute steps i), ii) and iii) during a second control cycle period.

14. The controller of claim 13 wherein said one or more indications are inversely related to said air flow through said sub slab and wherein said ratios are computed by dividing said desired indications by said measured indications.

15. The controller of claim 14 wherein said one or more indications comprise a contaminant level in said first building, said contaminant being a vapor originating below said sub slab.

16. The controller of claim 13 wherein said one or more indications comprise a flow rate in said duct.

17. The controller of claim 13 wherein said one or more indications comprise a pressure in said duct relative to a pressure in said building.

* * * * *